US011820410B2

(12) United States Patent
Liu

(10) Patent No.: US 11,820,410 B2
(45) Date of Patent: Nov. 21, 2023

(54) TRAIN DISPATCHING METHOD AND APPARATUS, COMPUTER-READABLE STORAGE MEDIUM, AND ELECTRONIC DEVICE

(71) Applicant: BYD COMPANY LIMITED, Shenzhen (CN)

(72) Inventor: Weizhao Liu, Shenzhen (CN)

(73) Assignee: BYD COMPANY LIMITED, Shenzhen (CN)

( * ) Notice: Subject to any disclaimer, the term of this patent is extended or adjusted under 35 U.S.C. 154(b) by 16 days.

(21) Appl. No.: 17/637,911

(22) PCT Filed: Aug. 28, 2020

(86) PCT No.: PCT/CN2020/112242
§ 371 (c)(1),
(2) Date: Feb. 24, 2022

(87) PCT Pub. No.: WO2021/037238
PCT Pub. Date: Mar. 4, 2021

(65) Prior Publication Data

US 2022/0281497 A1 Sep. 8, 2022

(30) Foreign Application Priority Data

Aug. 28, 2019 (CN) ..... 201910804062.0

(51) Int. Cl.
*G05D 1/00* (2006.01)
*B61L 27/16* (2022.01)
(Continued)

(52) U.S. Cl.
CPC ..... *B61L 27/16* (2022.01); *B61L 27/12* (2022.01); *B61L 27/14* (2022.01)

(58) Field of Classification Search
CPC ..... B61L 27/16; B61L 27/12; B61L 27/14; B61L 27/00; G05D 1/00
(Continued)

(56) References Cited

U.S. PATENT DOCUMENTS 9,268,334 B1 * 2/2016 Vavrick ..... B60L 58/12
2012/0160124 A1 * 6/2012 Barbee ..... B61C 5/00 105/35
(Continued)

FOREIGN PATENT DOCUMENTS

CN 102881220 A 1/2013
CN 105083336 A 11/2015
(Continued)

OTHER PUBLICATIONS

The World Intellectual Property Organization (WIPO) International Search Report for PCT/CN2020/112242 dated Dec. 2, 2020 4 pages (with translation).

*Primary Examiner* — Shardul D Patel
(74) *Attorney, Agent, or Firm* — Wenye Tan

(57) ABSTRACT

A train dispatching method includes acquiring a battery state of a power battery of a first target train, and determining that the first target train is a train about to return to the garage if the battery state is a power shortage state. The method further includes controlling the first target train to travel back to the parking garage for charging in response to receiving a passenger-drop-off completion instruction, selecting a train in a power sufficient state as a second target train from assignable trains in the parking garage if the battery state is the power shortage state, determining target dispatching plan information of the second target train according to original dispatching plan information of the first target train, and dispatching the second target train according to the target dispatching plan information.

8 Claims, 3 Drawing Sheets

(51) Int. Cl.
*B61L 27/14* (2022.01)
*B61L 27/12* (2022.01)

(58) Field of Classification Search
USPC ..... 701/19
See application file for complete search history.

(56) References Cited

U.S. PATENT DOCUMENTS

| | | | | |
|---|---|---|---|---|
| 2015/0006002 | A1* | 1/2015 | Yamane | G06Q 50/30 701/22 |
| 2016/0034720 | A1* | 2/2016 | Nakayama | G06F 21/79 713/193 |
| 2017/0297432 | A1* | 10/2017 | Ogawa | B60L 3/0023 |

FOREIGN PATENT DOCUMENTS

| | | | |
|---|---|---|---|
| CN | 105103206 | A | 11/2015 |
| CN | 105501262 | A | 4/2016 |
| CN | 105539184 | A | 5/2016 |
| CN | 106114521 | A | 11/2016 |
| CN | 106203740 | A | 12/2016 |
| CN | 205836815 | U | 12/2016 |
| CN | 107878512 | A | 4/2018 |
| CN | 208069687 | U | 11/2018 |
| CN | 109823374 | A | 5/2019 |
| JP | 2014034358 | A | 2/2014 |
| JP | 2014069621 | A | 4/2014 |

* cited by examiner

TRAIN DISPATCHING METHOD AND APPARATUS, COMPUTER-READABLE STORAGE MEDIUM, AND ELECTRONIC DEVICE

CROSS-REFERENCE TO RELATED APPLICATIONS

This application is a national stage entry under 35 U.S.C. § 371 of International Application No. PCT/CN2020/112242, filed on Aug. 28, 2020, which claims priority to Chinese Patent Application No. 201910804062.0, entitled "TRAIN DISPATCHING METHOD AND APPARATUS, COMPUTER-READABLE STORAGE MEDIUM, AND ELECTRONIC DEVICE", filed on Aug. 28, 2019, the entire contents of all of which are incorporated herein by reference.

FIELD

The present disclosure relates to the technical field of public transport, and in particular, to a train dispatching method and apparatus, a computer-readable storage medium, and an electronic device.

BACKGROUND

Conventional trains require to be equipped with overhead cables or conductive rails paved on the lines to provide power for the trains. For example, the trains equipped with the overhead cables use pantographs or trolley poles to obtain electric power from the overhead cables as the driving force. However, the overhead cables affect the urban landscape, and causes inflexibility of the trains.

With the development of the rail transit fully automatic operation signal system and power batteries for new energy vehicles, new energy power batteries start to replace the overhead cables to be applied to trains, reducing the costs required for paving conductive rails to provide electric power for the trains. However, during practical application, how to perform charging management on new energy trains is the key to guarantee normal operation of the new energy trains.

SUMMARY

The present disclosure aims to resolve at least one of the technical problems existing in the related art.

Therefore, a first solution of the present disclosure provides a train dispatching method.

A second solution of the present disclosure provides a train dispatching apparatus.

A third solution of the present disclosure provides a computer-readable storage medium.

A fourth solution of the present disclosure provides an electronic device.

In order to achieve the above objectives, a first aspect of embodiments of the present disclosure provides a train dispatching method is provided. The method includes: acquiring a battery state of a power battery of a first target train, where the first target train is a train traveling toward a terminal station platform of a terminal station having a parking garage and is at a distance less than a preset distance threshold from the terminal station platform; determining that the first target train is a train about to return to the garage if the battery state is a power shortage state; controlling the first target train to travel back to the parking garage for charging in response to receiving a passenger-drop-off completion instruction, where the passenger-drop-off completion instruction is used for indicating that the first target train arrives at the terminal station platform and completes passenger-drop-off; selecting, from assignable trains in the parking garage, a train in a power sufficient state as a second target train if the battery state is the power shortage state; determining target dispatching plan information of the second target train according to original dispatching plan information of the first target train; and dispatching the second target train according to the target dispatching plan information.

A second aspect of the embodiments of the present disclosure provides a train dispatching apparatus. The apparatus includes: an acquisition module, configured to acquire a battery state of a power battery of a first target train, where the first target train is a train traveling toward a terminal station platform of a terminal station having a parking garage and is at a distance less than a preset distance threshold from the terminal station platform; a first determination module, configured to determine that the first target train is a train about to return to the garage if the battery state is a power shortage state; a control module, configured to control the first target train to travel back to the parking garage for charging in response to receiving a passenger-drop-off completion instruction, where the passenger-drop-off completion instruction is used for indicating that the first target train arrives at the terminal station platform and completes passenger-drop-off; a selection module, configured to select, from assignable trains in the parking garage, a train in a power sufficient state as a second target train if the battery state is the power shortage state; a second determination module, configured to determine target dispatching plan information of the second target train according to original dispatching plan information of the first target train; and a dispatching module, configured to dispatch the second target train according to the target dispatching plan information.

A third aspect of the embodiments of the present disclosure provides a computer readable medium having a computer program stored therein. When the program is executed by a processor, steps of the train dispatching method in the first aspect of the present disclosure are performed.

A fourth aspect of the embodiments of the present disclosure provides an electronic device. The electronic device includes: a memory, storing a computer program therein; and a processor, configured to execute the computer program in the memory, to implement steps of the train dispatching method in the first aspect of the present disclosure.

According to the solutions in the present disclosure, the train on the application line in the power shortage state is controlled to travel back to the parking garage, and the train in the parking garage in a power sufficient state is controlled to continue the operation plan of the train in the power shortage state. Therefore, the train on the application line in the power sufficient state can be timely charged, and the original operation plan of the train is prevented from being affected when the train returns to the garage for charging. In this way, the train operation efficiency is enhanced.

Other features and advantages of the present disclosure will be described in detail in the following detailed description part.

BRIEF DESCRIPTION OF THE DRAWINGS

The accompanying drawings are intended to provide further understanding of the present disclosure and constitute a part of this specification. The accompanying drawings and the specific implementations below are used together for explaining the present disclosure rather than constituting a limitation to the present disclosure. In the accompanying drawings.

DETAILED DESCRIPTION

Specific implementations of the present disclosure are described in detail below with reference to the accompanying drawings. It should be understood that the specific implementations described herein are merely used to describe and explain the present disclosure, but are not intended to limit the present disclosure.

Figure 1:
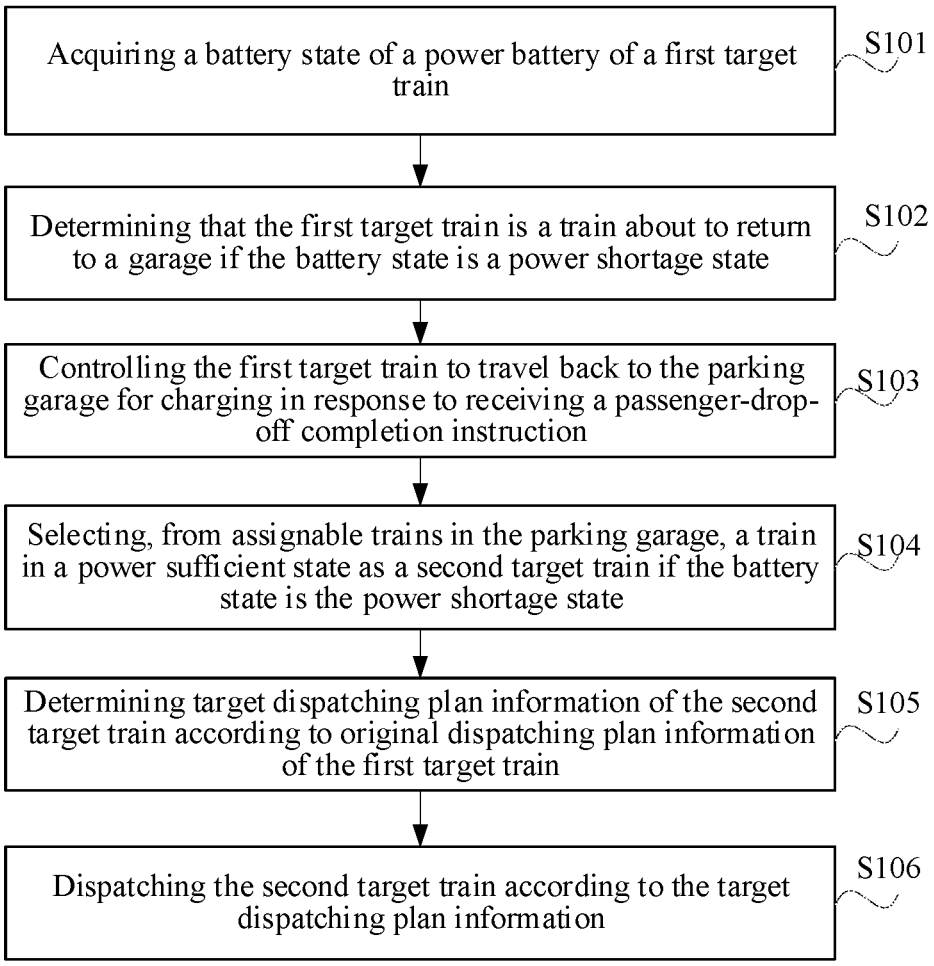
FIG. 1 is a flowchart of a train dispatching method according to an exemplary embodiment of the present disclosure.

FIG. 1 is a flowchart of a train dispatching method according to an exemplary embodiment of the present disclosure. The method is applicable to a server, for example, an application server configured to control train operation. As shown in FIG. 1, the method may include the following steps:

S101: Acquiring a battery state of a power battery of a first target train.

The first target train is a train traveling toward a terminal station platform of a terminal station having a parking garage and is at a distance less than a preset distance threshold from the terminal station platform.

In the present disclosure, the parking garage provides parking and automatic charging for trains. The parking garage is required to be built near the terminal station platform of the terminal station allowing drop-off of passengers. Two tie lines are established between the terminal station platform of the terminal station on an application line and the parking garage. One of the tie lines is used for a train to travel out of the parking garage to the application line, and the other of the tie lines is used for a train on the application line to travel back to the parking garage. Therefore, the train traveling out of the parking garage and the train traveling into the parking garage can achieve travel into and out of the parking garage simultaneously. In this way, the operation efficiency of the train is effectively enhanced, and manual intervention is not required, thereby achieving automatic traveling into or out of the parking garage. The application line has a departure station and a terminal station. The departure station and the terminal station respectively have a departure station platform and a terminal station platform. In addition to the departure station platform and the terminal station platform, the application line may include a plurality of stations. Alternatively, the application line may not include other stations. In addition, the application line may include one or more parking garages. This is not specifically limited herein. A preset distance threshold may be determined according to a longest duration required for wakening up a train in the parking garage and a longest duration required for a train to travel from the parking garage to the terminal station platform of the application line. Specifically, a shortest duration required for a train to travel by the preset distance threshold should be greater than a sum of the longest duration required for wakening up the train in the parking garage and the longest duration required for the train to travel from the parking garage to the terminal station platform of the application line.

S102: Determining that the first target train is a train about to return to the garage if the battery state is a power shortage state.

In the present disclosure, a power battery detection module may be mounted to the train. The module is connected to a battery management system in a power battery pack of the train. The power battery detection module can acquire the battery state of power batteries of the train in real time. The battery state of the train includes a power sufficient state and a power shortage state. For example, a state of charge threshold of the train may be preset in the server. If a state of charge of a power battery of the first target train is greater than or equal to the state of charge threshold, it is determined that the battery state of the first target train is the power sufficient state. If the state of charge of the power battery of the first target train is less than the state of charge threshold, it is determined that the battery state of the first target train is the power shortage state. It is to be noted that, the method for determining the battery state of the first target train is not limited to the above, and other methods that can be used to determine the battery state of the train are also applicable to the present disclosure.

S103: Controlling the first target train to travel back to the parking garage for charging in response to receiving a passenger-drop-off completion instruction.

The passenger-drop-off completion instruction is used for indicating that the first target train arrives at the terminal station platform and completes passenger-drop-off.

S104: Selecting, from assignable trains in the parking garage, a train in a power sufficient state as a second target train if the battery state is the power shortage state.

For example, the assignable trains may be trains in the parking garage in the power sufficient state that are not dispatched. In another example, the assignable trains may be trains in the parking garage in the power sufficient state that are not dispatched within a duration of the following operation plan of the first target train.

S105: Determining target dispatching plan information of the second target train according to original dispatching plan information of the first target train.

S106: Dispatching the second target train according to the target dispatching plan information.

According to the above solutions, the train on the application line in the power shortage state is controlled to travel back to the parking garage, and the train in the parking garage in a power sufficient state is controlled to continue the operation plan of the train in the power shortage state. Therefore, the train on the application line in the power shortage state can be timely charged, and the original operation plan of the train is prevented from being affected when the train returns to the garage for charging. In this way, the train operation efficiency is enhanced.

Figure 2:
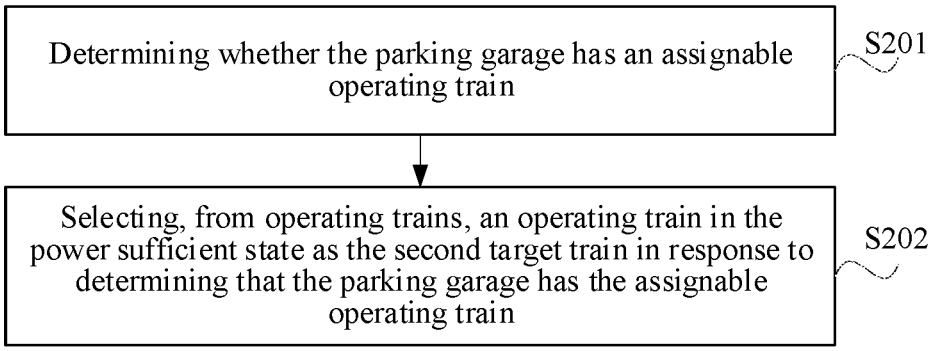
FIG. 2 is a flowchart of a method for selecting a second target train according to an exemplary embodiment of the present disclosure.

FIG. 2 is a flowchart of a method for selecting a second target train according to an exemplary embodiment of the present disclosure. As shown in FIG. 2, the selection method may include the following steps:

S201: Determining whether the parking garage has an assignable operating train. The parking garage includes at least one operating train and at least one standby train.

S202: Selecting, from the at least one operating train, an operating train in the power sufficient state as the second target train in response to determining that the parking garage has the assignable operating train.

The method for determining the battery state of the train has been described in detail above, and therefore is not described herein again.

Optionally, the selection method may further include selecting, from the at least one standby train in the parking garage, a standby train in the power sufficient state as the second target train in response to determining that the parking garage has no assignable operating train.

In the present disclosure, the parking garage includes at least one operating train and at least one standby train. When the parking garage has a plurality of assignable operating trains, any operating train in the power sufficient state may be selected as the second target train. When the parking garage has no assignable operating train, a standby train in the power sufficient state may be selected from the at least one standby train in the parking garage as the second target train.

Figure 3:
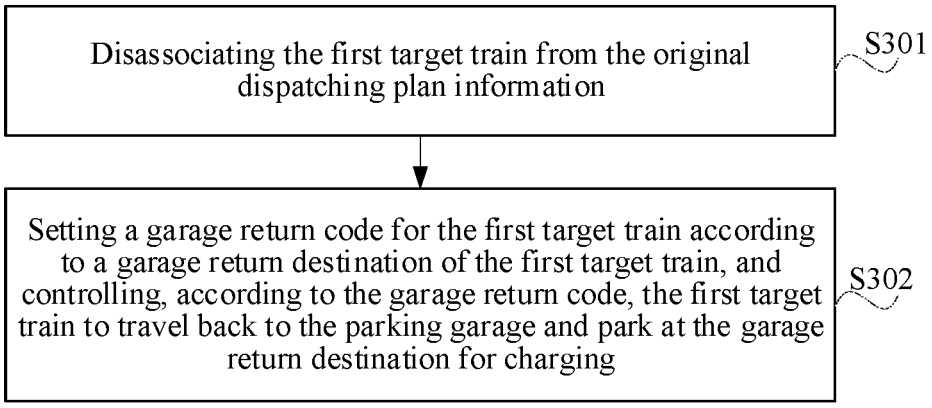
FIG. 3 is a flowchart of a method for a first target train to travel back to a parking garage according to an exemplary embodiment of the present disclosure.

FIG. 3 is a flowchart of a method for a first target train to travel back to a parking garage according to an exemplary embodiment of the present disclosure. As shown in FIG. 3, the method may include the following steps:

S301: Disassociating the first target train from the original dispatching plan information.

In the present disclosure, when train management staff set the original dispatching plan information for the first target train in an application server, the application server may associate the first target train with the original dispatching plan information, to control, according to the original dispatching plan information, the first target train to operate. After the first target train enters the power shortage state, arrives at the terminal station platform, and completes passenger-drop-off, the application server disassociates the first target train from the original dispatching plan information, to prevent the first target train from further operating according to the original dispatching plan information.

S302: Setting a garage return code for the first target train according to a garage return destination of the first target train, and controlling, according to the garage return code, the first target train to travel back to the parking garage and park at the garage return destination for charging.

The garage return destination of the first target train may be determined according to a status of the current parking garage. Specifically, a currently idle parking spot that can provide charging may be selected from the current parking garage as the garage return destination, and the garage return code is set for the first target train according to the garage return destination. The garage return code indicates the garage return destination. Therefore, the application server can control, according to the garage return code, the first target train to travel back to the parking garage and park at the garage return destination for charging.

In the present disclosure, the original dispatching plan information of the first target train may include a task start time, a task starting location, a task schedule number, and a task train number in a next operation plan of the first target train.

In the present disclosure, the task schedule number is application line information of travel of the first target train. Specifically, a travel application line of the first target train includes a platform 1, a platform 2, a platform 3, a platform 4, and a platform 5. The first target train cyclically operate back and forth between the platform 1 and the platform 5. The platform 1 and the platform 5 are respectively a departure station platform and a terminal station platform. The first target train travels back and forth between the platform 1 and the platform 5, and is updated with a train number. For example, the train number is updated when the first target train travels from the platform 1 to the platform 5, and is updated again when the first target train travels from the platform 5 to the platform 1. In the present disclosure, a line on which the first target train runs from the platform 1 to the platform 5 may be set as an upline, and a line on which the first target train runs from the platform 5 to the platform 1 may be set as a downline. The upline and the downline form the application line information, and the application line information is the task schedule number. It is to be noted that, the line on which the first target train runs from the platform 1 to the platform 5 may alternatively be set as the downline, and the line on which the first target train runs from the platform 5 to the platform 1 may be set as the upline. This is not specifically limited in the present disclosure. For example, the first target train travels back and forth between the platform 1 and the platform 5, and a schedule number of the first target train is set as 0x003. In this case, the task schedule number in the next operation plan is 0x003.

The task start time is a departure time in the next operation plan of the first target train. The task starting location is a departure station platform in the next operation plan of the first target train. The task train number is a train number in the next operation plan of the first target train. For example, planned train numbers of the first target train in an original dispatching plan are successively a train number 001, a train number 002, a train number 003, a train number 004, a train number 005, and a train number 006. The train number 001, the train number 003, and the train number 005 are train numbers from the platform 1 to the platform 5. The train number 002, the train number 004, and the train number 006 are train numbers from the platform 5 to the platform 1. If the first target train runs from the platform 1 to the platform 5, the train number is the train number 003, and the battery state is the power shortage state, the task start time in the next operation plan of the first target train is a task start time of the train number 004, the task starting location is a departure station platform of the train number 004, that is, the platform 5, and the task train number is the train number 004.

The determining target dispatching plan information of the second target train according to original dispatching plan information of the first target train includes: determining the task start time in the next operation plan of the first target train as a target task start time of the second target train; determining the task starting location in the next operation plan of the first target train as a target task starting location of the second target train; determining the task schedule number in the next operation plan of the first target train as a target task schedule number of the second target train; or determining the task train number in the next operation plan of the first target train as a target task train number of the second target train.

According to the above example, the target task train number is the train number 004, the target task start time of the second target train is the task start time of the train number 004, the target task starting location is the departure station platform of the train number 004, that is, the platform 5, and the target task schedule number is 0x003.

The determining target dispatching plan information of the second target train according to original dispatching plan information of the first target train further includes determining a wake-up moment of the second target train according to the target task start time and an estimated duration required for the second target train to run from a parking position to the target task starting location. The target dispatching plan information of the second target train includes the target task start time, the target task starting location, the target task schedule number, the target task train number, and the wake-up moment.

In the present disclosure, the estimated required duration may be a default empirical value. For example, the target task start time is 15:00, a duration required for successfully wakening up the second target train from a dormant state is 20 minutes, and the estimated duration required for the second target train to run from the parking position to the target task starting location is 35 minutes. In this case, the wake-up moment of the second target train may be determined as 14:05 or a moment slightly earlier than 14:05. No specific limitations are imposed on the wake-up moment in the present disclosure, as long as it is ensured that the second target train can arrive at the target task starting location on time and operates according to the target task start time.

For example, the task start time in the next operation plan of the first target train is 15:00, the task starting location is Z1, the task schedule number is 0x003, and the task train number is 0x108. In this case, the target task start time included in the target dispatching plan information of the second target train is 15:00, the target task starting location is Z1, the target task schedule number is 0x003, the target task train number is 0x108, and the wake-up moment is 14:05. The target dispatching plan information of the second target train is recorded in a garage exit and entrance plan of the second target train to manage the second target train.

In the present disclosure, the task start time, the task starting location, the task schedule number, and the task train number in the next operation plan of the first target train are respectively determined as the target task start time, the target task starting location, the target task schedule number, and the target task train number of the second target train, and the target dispatching plan information of the second target train is added to the garage exit and entrance plan of the day. Therefore, the second target train can complete the following operation plan for the first target train. In this way, the original operation plan of the task train is prevented from being affected by the power shortage state, and the train operation efficiency of is improved.

Figure 4:
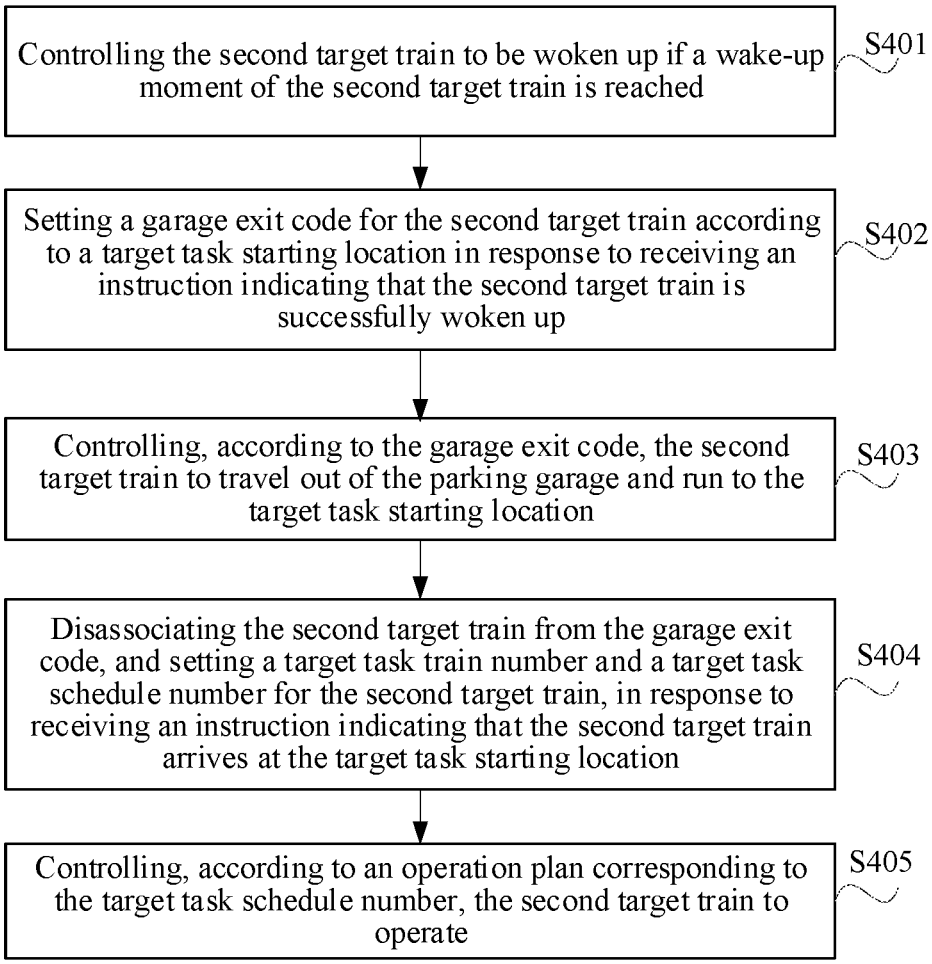
FIG. 4 is a flowchart of a method for dispatching a second target train according to target dispatching plan information according to an exemplary embodiment of the present disclosure.

FIG. 4 is a flowchart of a method for dispatching a second target train according to target dispatching plan information according to an exemplary embodiment of the present disclosure. As shown in FIG. 4, the method may include the following steps:

S401: Controlling the second target train to be woken up if the wake-up moment of the second target train is reached.

For example, when the wake-up moment of the second target train is reached, the application server may transmit a remote wake-up instruction to the second target train, to control the second target train to be woken up. In addition, if an instruction indicating that the second target train is successfully woken up is not received within a preset time, train wake-up abnormality alarm information is outputted for manual handling.

S402: Setting a garage exit code for the second target train according to the target task starting location in response to receiving an instruction indicating that the second target train is successfully woken up.

S403: Controlling, according to the garage exit code, the second target train to travel out of the parking garage and run to the target task starting location.

In the present disclosure, the target task starting location of the second target train is the task starting location in the next operation plan of the first target train, that is, the departure station platform of the next operation plan of the first target train. The garage exit code is set for the second target train according to the target task starting location. The garage exit code is the target task starting location. Therefore, the application server can control, according to the garage exit code, the second target train to travel out of the parking garage and run to the above departure station platform. For example, after the second target train is successfully woken up, a remote departure instruction may be transmitted to the second target train, to control the second target train to automatically travel from the parking garage to the target task starting location.

S404: Disassociating the second target train from the garage exit code, and setting the target task train number and the target task schedule number for the second target train, in response to receiving an instruction indicating that the second target train arrives at the target task starting location.

S405: Controlling, according to an operation plan corresponding to the target task schedule number, the second target train to operate.

In the present disclosure, after an instruction indicating that the second target train arrives at the target task starting location is received, the second target train is disassociated from the garage exit code, and the target task train number and the target task schedule number are set for the second target train, so as to control the second target train to execute the following operation plan of the first target train corresponding to the target task schedule number. According to the above example, the target task schedule number is 0x003. When the first target train runs from the platform 1 to the platform 5, the train number is the train number 003, and the battery state is the power shortage state, the second target train is controlled according to the operation plan corresponding to the target task schedule number to operate. That is to say, the second target train is controlled to execute the operation plan after the train number 003, that is, operation plans of the train number 004, the train number 005, and the train number 006.

Therefore, the second target train can be controlled to automatically travel out of the parking garage and operate according to the operation plan corresponding to the target task schedule number, thereby achieving further operation according to the plan for the first target train by using the second target train. In this way, not only the problem about train charging is resolved, but also the train operation efficiency is enhanced.

In the present disclosure, the original dispatching plan information of the first target train may further include a garage return schedule number, a garage return time, and a garage return train number of the first target train.

The garage return schedule number of the first target train is a schedule number corresponding to a last operation plan in the original dispatching plan information of the first target train before the first target train travels back to the parking garage.

According to the above example, the garage return schedule number is 0x003.

The determining target dispatching plan information of the second target train according to original dispatching plan information of the first target train further includes: determining the garage return schedule number of the first target train as a target garage return schedule number of the second target train; determining the garage return time of the first target train as a target garage return time of the second target train; determining the garage return train number of the first target train as a target garage return train number of the second target train; and determining the parking position of the second target train as a target garage return destination of the second target train, where the target dispatching plan information further includes the target garage return schedule number, the target garage return time, the target garage return train number, and the target garage return destination.

For example, the garage return schedule number of the first target train is 0x003, the garage return train number is 0x164, the garage return time is 20:05, and a parking position before the second target train travels out of the garage is K6. In this case, the target garage return schedule number included in garage return information of the second target train is 0x003, the target garage return train number is 0x164, the target garage return time is 20:05, and the target garage return destination is K6. The target dispatching plan information of the second target train is recorded in the garage exit and entrance plan of the second target train to manage the second target train.

In the present disclosure, the garage return schedule number, the garage return time, and the garage return train number of the first target train are respectively determined as the target garage return schedule number, the target garage return time, and the target garage return train number of the second target train, and the parking position of the second target train is determined as the target garage return destination of the second target train. The target dispatching plan information of the second target train is added to the garage exit and entrance plan of the day, so as to collectively manage the trains.

Figure 5:
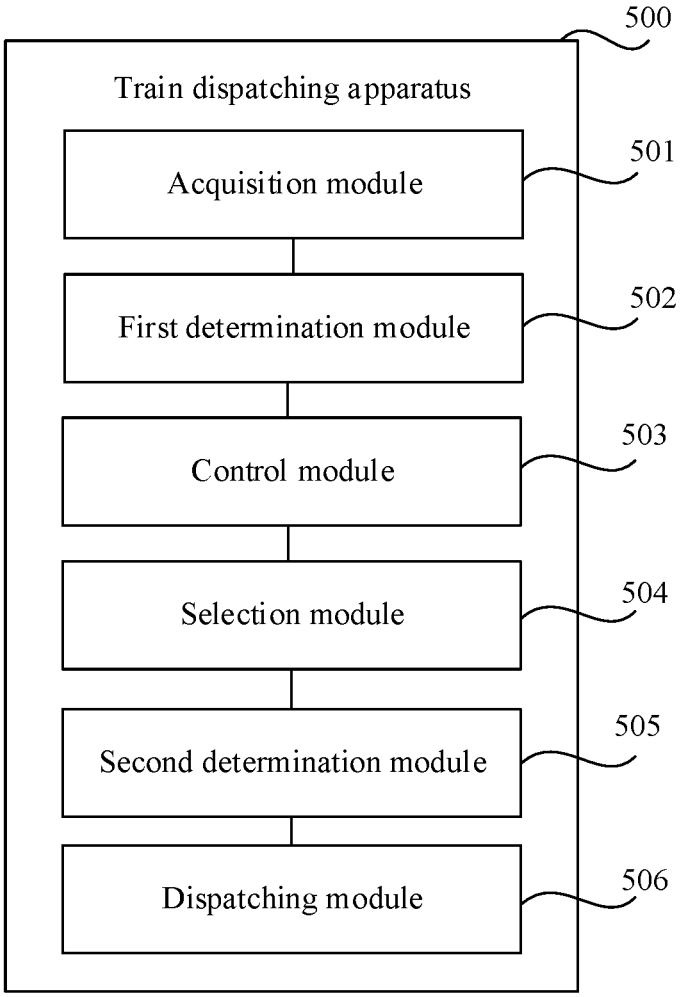
FIG. 5 is a block diagram of a train dispatching apparatus according to an exemplary embodiment of the present disclosure.

FIG. 5 is a block diagram of a train dispatching apparatus according to an exemplary embodiment of the present disclosure. As shown in FIG. 5, the apparatus 500 may include: an acquisition module 501, configured to acquire a battery state of a power battery of a first target train, where the first target train is a train traveling toward a terminal station platform of a terminal station having a parking garage and is at a distance less than a preset distance threshold from the terminal station platform; a first determination module 502, configured to determine that the first target train is a train about to return to the garage if the battery state is a power shortage state; a control module 503, configured to control the first target train to travel back to the parking garage for charging in response to receiving a passenger-drop-off completion instruction, where the passenger-drop-off completion instruction is used for indicating that the first target train arrives at the terminal station platform and completes passenger-drop-off; a selection module 504, configured to select, from assignable trains in the parking garage, a train in a power sufficient state as a second target train if the battery state is the power shortage state; a second determination module 505, configured to determine target dispatching plan information of the second target train according to original dispatching plan information of the first target train; and a dispatching module 506, configured to dispatch the second target train according to the target dispatching plan information.

According to the solutions in the present disclosure, the train on the application line in the power shortage state is controlled to travel back to the parking garage, and the train in the parking garage in a power sufficient state is controlled to continue the operation plan of the train in the power shortage state. Therefore, the train on the application line in the power shortage state can be timely charged, and the original operation plan of the train is prevented from being affected when the train returns to the garage for charging. In this way, the train operation efficiency is enhanced.

Optionally, the selection module 504 includes: a first determination sub-module, configured to determine whether the parking garage has an assignable operating train, where the parking garage includes at least one operating train and at least one standby train; and a first selection sub-module, configured to select, from the at least one operating train, an operating train in the power sufficient state as the second target train in response to determining that the parking garage has the assignable operating train.

Optionally, the selection module 504 further includes a second selection sub-module, configured to select, from the at least one standby train in the parking garage, a standby train in the power sufficient state as the second target train in response to determining that the parking garage has no assignable operating train.

Optionally, the control module 503 includes a first disassociating sub-module, configured to disassociate the first target train from the original dispatching plan information and a first setting sub-module, configured to set a garage return code for the first target train according to a garage return destination of the first target train, and control, according to the garage return code, the first target train to travel back to the parking garage and park at the garage return destination for charging.

Optionally, the original dispatching plan information includes a task start time, a task starting location, a task schedule number, and a task train number in a next operation plan of the first target train. The second determination module 505 includes: a second determination sub-module, configured to determine the task start time in the next operation plan of the first target train as a target task start time of the second target train, determine the task starting location in the next operation plan of the first target train as a target task starting location of the second target train, determine the task schedule number in the next operation plan of the first target train as a target task schedule number of the second target train, determine the task train number in the next operation plan of the first target train as a target task train number of the second target train, and determine a wake-up moment of the second target train according to the target task start time and an estimated duration required for the second target train to run from a parking position to the target task starting location, where the target dispatching plan information includes the target task start time, the target task starting location, the target task schedule number, the target task train number, and the wake-up moment.

Optionally, the dispatching module 506 includes: a first control sub-module, configured to control the second target train to be woken up if the wake-up moment of the second target train is reached; a second setting sub-module, configured to set a garage exit code for the second target train according to the target task starting location in response to receiving an instruction indicating that the second target train is successfully woken up; a second control sub-module, configured to control, according to the garage exit code, the second target train to travel out of the parking garage and run to the target task starting location; a second disassociating sub-module, configured to disassociate the second target train from the garage exit code, and set the target task train number and the target task schedule number for the second target train, in response to receiving an instruction indicating that the second target train arrives at the target task starting location; and a third control sub-module, configured to control, according to an operation plan corresponding to the target task schedule number, the second target train to operate.

Optionally, the original dispatching plan information further includes a garage return schedule number, a garage return time, and a garage return train number of the first target train. The second determination module 505 further includes: a third determination sub-module, configured to determine the garage return schedule number of the first target train as a target garage return schedule number of the second target train, determine the garage return time of the first target train as a target garage return time of the second target train, determine the garage return train number of the first target train as a target garage return train number of the second target train, and determine the parking position of the second target train as a target garage return destination of the second target train, where the target dispatching plan information further includes the target garage return schedule number, the target garage return time, the target garage return train number, and the target garage return destination.

Specific manners in which the modules in the apparatus in the above embodiment perform the operations have been described in detail in the embodiment related to the method, which are not described in detail herein.

Figure 6:
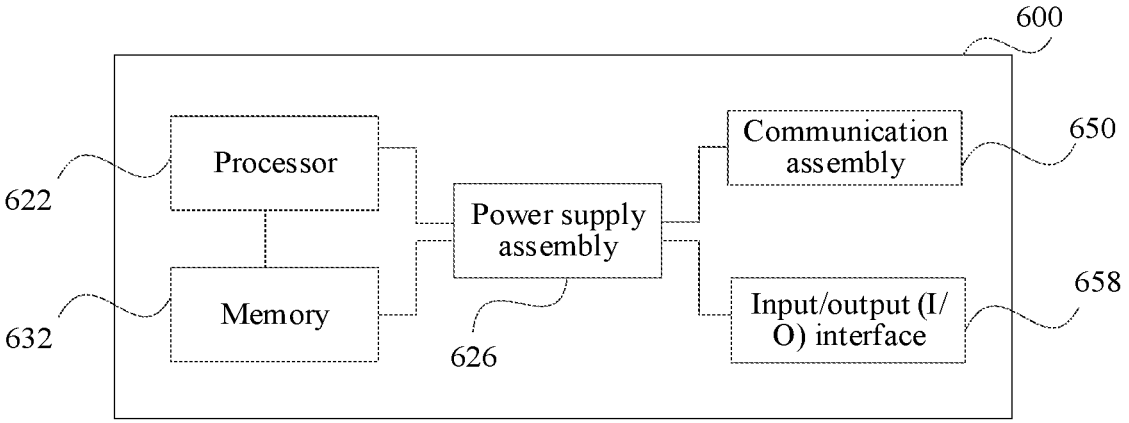
FIG. 6 is a block diagram of an electronic device according to an exemplary embodiment of the present disclosure.

FIG. 6 is a block diagram of an electronic device 600 according to an exemplary embodiment of the present disclosure. For example, the electronic device 600 may be provided as a server. Referring to FIG. 6, the electronic device 600 includes one or more processors 622 and a memory 632 configured to store a computer program executable by the processors 622. The computer program stored in the memory 632 may include one or more modules each corresponding to a set of instructions. Moreover, the processors 622 may be configured to execute the computer program to perform the above train dispatching method.

In addition, the electronic device 600 may further include a power supply assembly 626 and a communication assembly 650. The power supply assembly 626 may be configured to perform power management on the electronic device 600, and the communication assembly 650 may be configured to implement communication of the electronic device 600, such as, wired or wireless communication. Furthermore, the electronic device 600 may further include an input/output (I/O) interface 658. The electronic device 600 may operate an operating system stored in the memory 632, such as Windows Server™, Mac OS X™, Unix™, and Linux™.

In another exemplary embodiment, a computer-readable storage medium storing a computer program is further provided. When the computer program is executed by the processor, the steps of the above train dispatching method are performed. For example, the computer-readable storage medium may be the above memory 632 including the program instruction. The above program instruction may be executed by the processor 622 of the electronic device 600 to complete the above train dispatching method.

In another exemplary embodiment, a computer program product is further provided. The computer program product includes a computer program executable by a programmable apparatus. The computer program has a code part for executing the above train dispatching method when being executed by the programmable apparatus.

The preferred implementations of the present disclosure are described in detail above with reference to the accompanying drawings, but the present disclosure is not limited to the specific details in the above implementations. Various simple variations may be made to the technical solutions of the present disclosure within the scope of the technical idea of the present disclosure, and such simple variations should all fall within the protection scope of the present disclosure.

It should be further noted that the specific technical features described in the above specific implementations may be combined in any suitable manner without contradiction. To avoid unnecessary repetition, various possible combinations are not further described in the present disclosure.

In addition, different implementations of the present disclosure may also be arbitrarily combined without departing from the idea of the present disclosure, and these combinations shall still be regarded as content disclosed in the present disclosure.

What is claimed is:

1. A train dispatching method for a train dispatching system, comprising:

acquiring a battery state of a power battery of a first target train in real time by a power battery detection module mounted on the first target train, wherein the first target train is a train traveling toward a terminal station platform of a terminal station having a parking garage and is at a distance less than a preset distance threshold from the terminal station platform;

determining that the first target train is a train about to return to the parking garage if the battery state of the first target train is a power shortage state;

controlling the first target train to travel back to the parking garage for charging in response to receiving a passenger-drop-off completion instruction, wherein the passenger-drop-off completion instruction is used for indicating that the first target train arrives at the terminal station platform and completes passenger-drop-off;

selecting, from assignable trains in the parking garage, a train in a power sufficient state as a second target train if the battery state of the first target train is the power shortage state;

determining target dispatching plan information of the second target train according to original dispatching plan information of the first target train; and dispatching the second target train according to the target dispatching plan information such that the first target train in the power shortage state is controlled to travel back to the parking garage, and the second target train in the parking garage is controlled to continue an original dispatching plan of the first target train.

2. The method according to claim 1, wherein the selecting, from assignable trains in the parking garage, a train in a power sufficient state as a second target train comprises:

determining whether the parking garage has an assignable operating train, wherein the parking garage comprises at least one operating train and at least one standby train and selecting, from the at least one operating train, an operating train in the power sufficient state as the second target train in response to determining that the parking garage has the assignable operating train.

3. The method according to claim 2, wherein the selecting, from assignable trains in the parking garage, a train in a power sufficient state as a second target train further comprises:

selecting, from the at least one standby train in the parking garage, a standby train in the power sufficient state as the second target train in response to determining that the parking garage has no assignable operating train.

4. The method according to claim 1, wherein the controlling the first target train to travel back to the parking garage for charging comprises:

disassociating the first target train from the original dispatching plan information; and setting a garage return code for the first target train according to a garage return destination of the first target train, and controlling, according to the garage return code, the first target train to travel back to the parking garage and park at the garage return destination for charging.

5. The method according to claim 1, wherein the original dispatching plan information comprises: a task start time, a task starting location, a task schedule number, and a task train number in a next operation plan of the first target train; and the determining target dispatching plan information of the second target train according to original dispatching plan information of the first target train comprises:

determining the task start time in the next operation plan of the first target train as a target task start time of the second target train;

determining the task starting location in the next operation plan of the first target train as a target task starting location of the second target train;

determining the task schedule number in the next operation plan of the first target train as a target task schedule number of the second target train;

determining the task train number in the next operation plan of the first target train as a target task train number of the second target train; and determining a wake-up moment of the second target train according to the target task start time and an estimated duration required for the second target train to run from a parking position to the target task starting location, wherein the target dispatching plan information comprises the target task start time, the target task starting location, the target task schedule number, the target task train number, and the wake-up moment.

6. The method according to claim 5, wherein the dispatching the second target train according to the target dispatching plan information comprises:

controlling the second target train to be woken up if the wake-up moment of the second target train is reached;

setting a garage exit code for the second target train according to the target task starting location in response to receiving an instruction indicating that the second target train is successfully woken up;

controlling, according to the garage exit code, the second target train to travel out of the parking garage and run to the target task starting location;

disassociating the second target train from the garage exit code, and setting the target task train number and the target task schedule number for the second target train, in response to receiving an instruction indicating that the second target train arrives at the target task train number; and controlling, according to an operation plan corresponding to the target task schedule number, the second target train to operate.

7. The method according to claim 5, wherein the original dispatching plan information further comprises a garage return schedule number, a garage return time, and a garage return train number of the first target train; and the determining target dispatching plan information of the second target train according to original dispatching plan information of the first target train further comprises:

determining the garage return schedule number of the first target train as a target garage return schedule number of the second target train;

determining the garage return time of the first target train as a target garage return time of the second target train;

determining the garage return train number of the first target train as a target garage return train number of the second target train; and determining the parking position of the second target train as a target garage return destination of the second target train, wherein the target dispatching plan information further comprises the target garage return schedule number, the target garage return time, the target garage return train number, and the target garage return destination.

8. An electronic device, comprising:

a memory for storing a computer program; and a processor, configured to execute the computer program, and when executed, the computer program causing the processor to:

acquire a battery state of a power battery of a first target train in real time by a power battery detection module mounted on the first target train, wherein the first target train is a train traveling toward a terminal station platform of a terminal station having a parking garage and is at a distance less than a preset distance threshold from the terminal station platform;

determine that the first target train is a train about to return to the parking garage if the battery state of the first target train is a power shortage state;

control the first target train to travel back to the parking garage for charging in response to receiving a passenger-drop-off completion instruction, wherein the passenger-drop-off completion instruction is used for indicating that the first target train arrives at the terminal station platform and completes passenger-drop-off;

select, from assignable trains in the parking garage, a train in a power sufficient state as a second target train if the battery state of the first target train is the power shortage state;

determine target dispatching plan information of the second target train according to original dispatching plan information of the first target train; and dispatch the second target train according to the target dispatching plan information such that the first target train in the power shortage state is controlled to travel back to the parking garage, and the second target train in the parking garage is controlled to continue an original dispatching plan of the first target train.

* * * * *